United States Patent [19]

Goldstein

[11] Patent Number: 4,554,797

[45] Date of Patent: Nov. 26, 1985

[54] THERMAL STORAGE HEAT EXCHANGER SYSTEMS OF HEAT PUMPS

[76] Inventor: Vladimir Goldstein, 18 Killaloe Rd., Unit 4, Concord, Ontario, Canada, L4K 1C8

[21] Appl. No.: 656,246

[22] Filed: Oct. 1, 1984

Related U.S. Application Data

[63] Continuation-in-part of Ser. No. 459,747, Jan. 21, 1983, Pat. No. 4,480,445.

[51] Int. Cl.[4] ..... F25D 17/02

[52] U.S. Cl. ..... 62/434; 62/96; 62/123; 62/185

[58] Field of Search ..... 62/96, 123, 185, 434

[56] References Cited

U.S. PATENT DOCUMENTS

| | | | |
|---|---|---|---|
| 3,247,678 | 4/1966 | Mohlman | 62/185 |
| 4,078,392 | 3/1978 | Kestner | 62/434 |
| 4,294,083 | 10/1981 | King | 62/434 |
| 4,302,944 | 12/1981 | Gainer | 62/434 |
| 4,334,412 | 6/1982 | Wildfeuer | 62/434 |

*Primary Examiner*—Ronald C. Capossela

*Attorney, Agent, or Firm*—Fetherstonhaugh & Co.

[57] ABSTRACT

In a heat pump having a heat source, a heat sink and a thermal storage heat exchanger in which heat energy is cyclically accumulated and discharged by circulation of a secondary refrigerant therethrough, the improvement wherein: the secondary refrigerant is an aqueous solution having a concentration which is below its eutetic concentration, the heat sink is adapted to super cool the aqueous solution to partially freeze it to generate a partially frozen solution in which fine ice particles are retained in suspension, the thermal storage heat exchanger has a storage chamber, a first input communicating with said storage chamber for admitting said partially frozen solution from the heat sink to said storage chamber, a second input communicating with said storage chamber for admitting heated refrigerant from the heat source sink to said storage chamber, a first output communicating with said storage chamber for discharging liquid phase refrigerant from said storage chamber for circulation to said heat sink and/or said heat source.

11 Claims, 5 Drawing Figures

THERMAL STORAGE HEAT EXCHANGER SYSTEMS OF HEAT PUMPS

RELATED APPLICATIONS

This application is a continuation-in-part of application Ser. No. 459,747 filed Jan. 21, 1983 now U.S. Pat. No. 4,480,445.

FIELD OF INVENTION

This invention relates to improvements in heat pumps which may be used for heating or cooling and which have a thermal storage heat exchangers.

PRIOR ART

Thermal storage heat exchangers are commonly used in heat pumps in systems such as air conditioning systems in order to shift the loads which are applied to the system to achieve load leveling and avoid the need to provide a pump which is designed to meet the maximum load requirements when maximum load requirements are only required for a limited period of its day-to-day operation.

Heat pump systems which incorporate heat source, heat sink and a thermal storage heat exchanger are well known and the present invention is directed to improvements in such systems.

In U.S. Pat. No. 4,334,412 dated June 15, 1982, a cooling system is disclosed in which an ice slurry is circulated as the secondary refrigerant. A motor driven agitator is provided in the collection means for maintaining the ice in a slurry and this slurry is circulated through the system. To maintain the ice in a slurry form, it will be necessary to prevent a high concentration of ice in the collection device and as a result, the efficiency of the collection device will be somewhat limited.

In order to provide a thermal storage heat exchanger of high efficiency, I separate ice from the liquid phase refrigerant in the thermal storage heat exchanger so as to form a porous ice bed and a bath of secondary refrigerant within the thermal storage heat exchanger. This enables me to accumulate a dense porous ice bath during the cooling stage and through which I can pass the heated refrigerant in order to recover the stored energy during the peak cooling demand condition.

A refrigerant which is suitable for use in my system is a secondary refrigerant in the form of a binary solution having a concentration which is below its Eutectic concentration.

In order to generate a partially frozen refrigerant solution in which fine ice particles are retained in suspension, I use an ice making machine of the type described in my co-pending application Ser. No. 419,548 filed Sept. 17, 1982 now abandoned, the complete specification of which is incorporated herein by reference.

SUMMARY OF INVENTION

According to one aspect of the present invention, there is provided in a heat pump having a heat source, a heat sink and a thermal storage heat exchanger in which heat energy is cyclically accumulated and discharged by circulation of a secondary refrigerant therethrough, the improvement wherein; the secondary refrigerant is an aqueous soluation having a concentration which is below its eutetic concentration, the heat sink is adapted to cool or super-cool the aqueous solution to generate cooled secondary refrigerant, which, when cooled is a liquid and when super-cooled, is partially frozen and contains fine ice particles in suspension, the thermal storage heat exchanger has a storage chamber, a first input communicating between said storage chamber and the heat sink for admitting said cooled secondary refrigerant, such that when super-cooled secondary refrigerant is admitted the ice particles will separate from the liquid phase refrigerant to form a porous ice bed and a substantially ice free liquid bath, and when the cooled liquid is admitted it will be directed into intimate contact with the ice bed in a manner such that it may pass through the pores of the porous ice bed prior to its return to the bath, a first output communicating with said storage chamber for discharging liquid phase refrigerant from said storage chamber for circulation to said heat sink and/or said heat source.

PREFERRED EMBODIMENT

The invention will be more clearly understood after reference to the following detailed specification read in conjunction with the drawings wherein.

Figure 1:
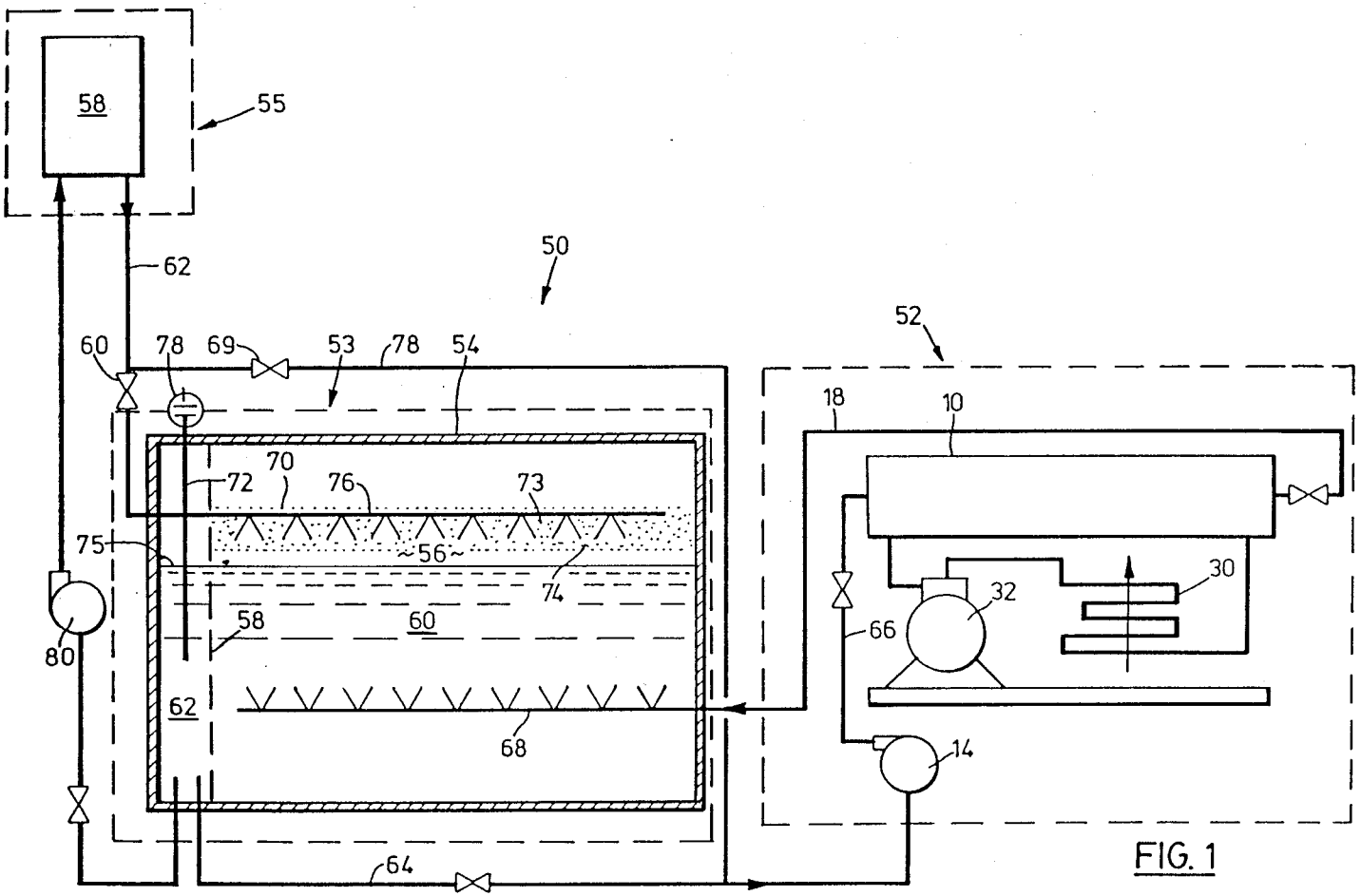
FIG. 1 is a diagram of a heat pump system constructed in accordance with an embodiment of the present invention.

With reference to FIG. 1 of the drawings the reference numeral 50 refers generally to a heat pump according to an embodiment of the present invention. The heat pump consists of an ice generator generally identified by the reference numeral 52, a heat source generally identified by the reference numeral 55 and a thermal storage heat exchanger generally identified by the reference numeral 53. The ice generator will be discribed in It will be noted that the output line 18 of the ice generator communicates with the thermal storage heat exchanger tank 56.

In the embodiment illustrated, the heat source 55 is in the form of a heat load device 58 which may be a heat exchanger in the form of a cooling coil, solar collector, chiller or the like.

The thermal storage heat exchanger 53 comprises a storage tank 54 within which a storage chamber 56 is formed. A barrier wall 58 serves to divide the storage chamber 56 into a first compartment 60 and a second compartment 62. The barrier wall 58 is porous and serves to permit liquid phase refrigerant to pass from the compartment 60 into the compartment 62 while preventing the passage of ice particles therebetween.

During the thermal storage phase of operation, the circulating pump 14 withdraws liquid phase secondary refrigerant from the second compartment 62 through a line 64 and discharges it under pressure into the ice generator 10 through line 66. The partially frozen solution containing the ice particles is discharged from the heat sink 52 through line 18 and enters the first chamber 60 through a return header 68 which is disposed in the lower end of the first compartment 60. The ice particles will float toward the surface 70 of the body of secondary refrigerant which is stored within the storage chamber 56 wherein they will accumulate to form a porous ice bed 74. By reason of the fact that the secondary refrigerant is an aqueous solution, the ice particles will not bridge to form a solid ice mask and consequently the ice bed which is formed, will be porous. This condition will remain even when the ice bed is compacted as a result of its buoyancy to form a compact ice bed which may substantially fill the chamber 60.

In order the avoid a situation where an excessive amount of ice is accumulated in the storage chamber 60, I provide a liquid level sensing device 78 which has a probe 72 which extends into the compartment 62. When the level of liquid in the compartment 62 drops below a predetermined level such as that indicated by the broken line 75, the sensor 70 will be activated to deactivate the ice generator 52.

Liquid phase refrigerant is withdrawn from the second compartment 62 by means of the circulating pump 80 of the heat source and it is circulated through the heat exchanger 58. A valve 60 is provided in the output line 62 of the solar collector. The valves 60 and 69 are operable to direct the heated refrigerant to the return header 76 of the thermal storage heat exchanger or the return line 78 which is connected to the circulating pump 14 of the ice generator. This circuit is made operational during high load demand periods and may be used to moderate the cooling effect.

The return header 76 is arranged to discharge the heated liquid phase refrigerant into contact with the ice bed such that the heated refrigerant must pass through at least a portion of the ice bed before it can be withdrawn from the first compartment 62, thus ensuring that it is cooled by contact with the ice bed. The porous nature of the ice bed is such that the heated refrigerant will pemiate the ice bed to thereby achieve an efficient heat exchange between the ice bed and the refrigerant.

A secondary refrigerant suitable for use in the system of the present invention may be a brine solution having a 5% to 10% concentration. Preferably, however, the themal storage medium is an aqueous solution having a glycol concentration in the range of 3% to 10% by weight. A suitable 10% glycol themal storage medium may have the following properties:

SPECIFIC HEAT—0.982 BTU/LB/° F.
FREEZING POINT—APPROX 27° F.
THERMAL CONDUCTIVITY (27°)—0.309 BTU/HR-FT$^2$-F/FT
VISCOSITY (27°)—2.8 CENTIPOISES
DENSITY—8.77 LB/IMP. GAL.

Figure 2:
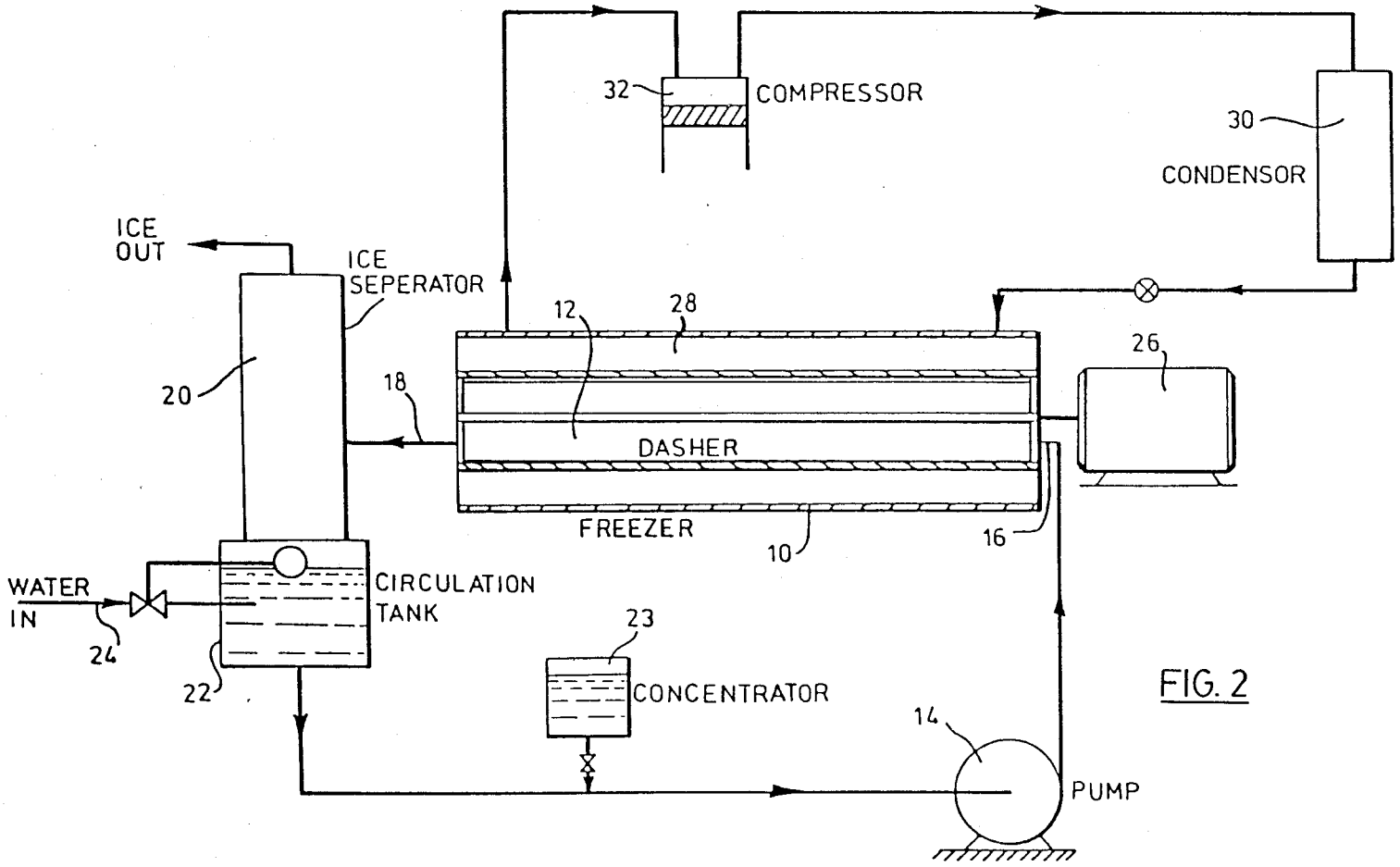
FIG. 2 is a schematic illustration of a heat sink suitable for use in super cooling a binary solution.

With reference to FIG. 2 of the drawings, the reference numeral 10 refers generally to a freezing cylinder which has a dasher chamber 12 through which a brine mixture is continuously circulated by means of a pump 14. The brine mixture enters the chamber at 16 and is cooled to be partially frozen to generate a partially frozen solution in which fine ice particles are retained in suspension. The mixture is then discharged through line 18 to the thermal storage heat exchanger 20 (FIG. 2). Within the dasher chamber, a scouring paddle is continuously rotated by motor 26 to scour the sides of the chamber and to prevent an ice build-up on them. The scouring paddle is of a standard design in these machines. The dasher chamber is surrounded by a jacket 28 to which a condensed refrigerant is continuously supplied from condenser 30. The refrigerant boils in the jacket and as it does so, it cools the brine mixture in the chamber to form the ice particles. The expanded refrigerant travels from the jacket to the compressor 32 where it is compressed and delivered to the condenser for continuous recycling as in a conventional refrigeration cycle.

As indicated, the freezer, dasher and scouring paddle and associated refrigerant circuit are standard and well known pieces of equipment and are not therefore described in detail.

With reference to FIG. 2 of the drawings, the characteristic curves of a brine mixture is disclosed in which the solvent is water and the solute is NaCl.

This solution will freeze at the Eutectic temperature or temperature of Eutectic indicated in the drawing. The physical phenomena that occur as the temperature of such a solution is cooled toward the freezing point depends upon its concentration. If the concentration is represented by a point to the left of the point D1 of the curve, ice crystals are formed and the concentration of the solvent in the solute increases as the freezing temperature is approached.

Figure 3:
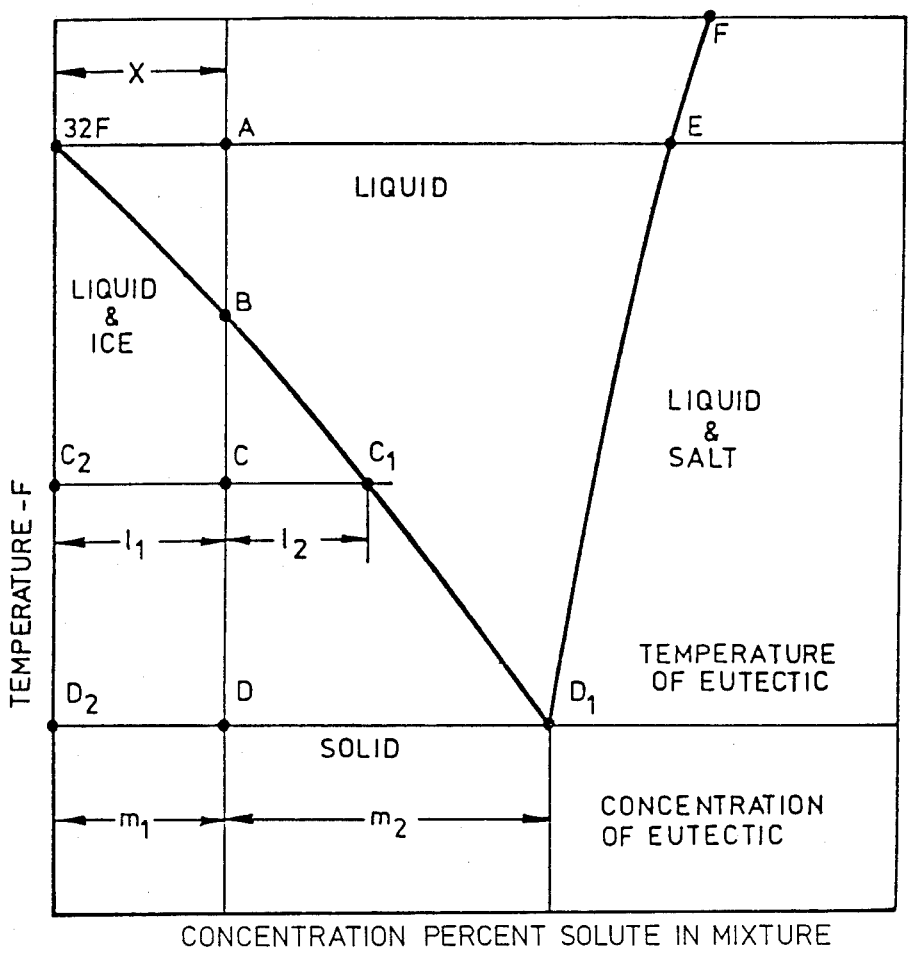
FIG. 3 is a diagram illustrating a temperature concentration curve of an aqueous solution suitable for use as a secondary refrigerant.

The temperature represented by the point D on the curve is known as the eutectic temperature and the concentration represented by the point $D_1$ on the curve is known as the Eutectic concentration. Referring to FIG. 3, if a solution of concentration x, less than the eutectic, at a temperature above 32° F., is cooled, it will not solidify when 32° F. is reached (point A), but continue to cool as a liquid until point B is reached. At this point, ice crystals of pure water will begin to form, accompanied by removal of their latent heat. This increases the concentration of the residual solution. As the temperature is lowered, these crystals continue to form, and the mixture of ice crystals and brine solution forms a slush. When point C is reached, there is a mixture of ice crystals $C_2$, and brine solution of concentration $C_1$, in the proportions of $1_1$ parts of brine to $1_2$ parts of ice crystals in $(1_1+1_2)$ parts of mixture. When the process has continued to point D, there is a mixture of $m_1$ parts of eutectic brine solution $D_1$, and $m_2$ part of ice $D_2$, all of the eutectic temperature. As more heat is removed, the $m_1$ parts of eutectic brine freeze at uniform temperature until all latent heat is removed. The frozen eutectic is a mechanical mixture of salt and frozen water, not a solution, and consequently the latent heat must be corrected for the heat of solution. If this is positive, it decreases effective latent heat; if negative, it increases the effective latent heat.

The ice particles which are formed by the ice generator have a diameter of about 0.002 to 0.005 inches and are made from and float in a proprietary binary solution containing water and emulsifying, antibacterial, antifungal and anticorrosive agents. The liquid also has controlled amounts of alcohol or glycol (for thermal storage applications) so that the working temperature may be set at 28° F. The ice crystals remain separated and do not form solid blocks of ice because the emulsifier prevents them from agglomerating in the binary solution. Since they do remain separated, the ice crystals have a higher heat transfer coefficient than solid ice and require no space-stealing freezer tubes in the storage tank and do not "bridge" in storage like conventional ice does.

For the purposes of this specification, the term "heat pump" is to be interpreted as any heating or cooling device which incorporates a heat sink, a heat source and a thermal storage heat exchanger used for heating or cooling.

Various modifications of the present invention will be apparent to those skilled in the art. For example, the thermal storage heat exchanger of the present invention may be incorporated in a conventional heat exchanger system.

Figure 4:
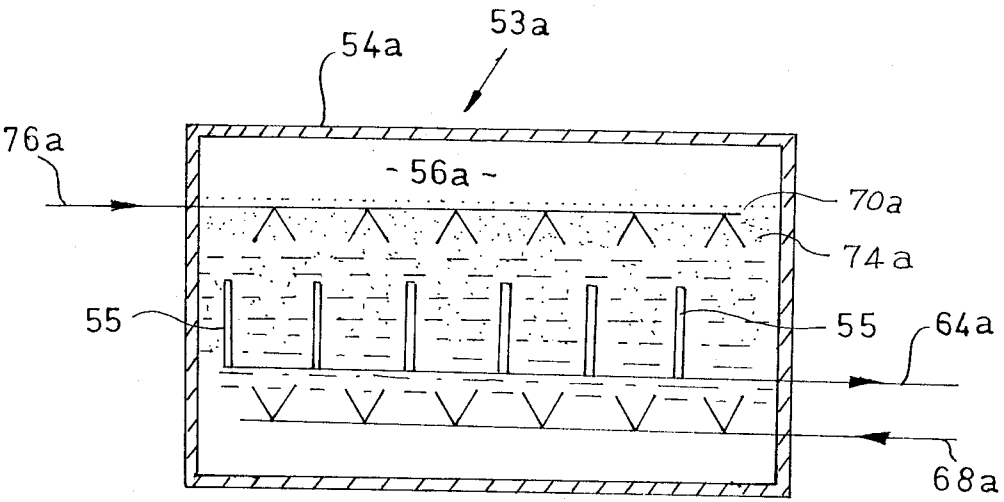
FIG. 4 is a diagram illustrating an alternative construction of a thermal storage heat exchanger.

An alternative thermal storage heat exchanger 53*a* is illustrated in FIG. 4. The thermal storage heat exchanger 53*a* comprises a storage tank 54*a* within which a storage chamber 56*a* is formed. In this embodiment the barrier wall 58 (FIG. 1) is not required as the liguid phase refrigerant is seperated from the ice by providing a plurality of intake tubes 55 each of which has a plurality of small diameter inlet passages spaced along the length thereof. These tubes 55 perform the same function as the barrier wall 58 in that they serve to seperate the liguid phase refrigerant from the ice and permit liquid phase refrigerant to pass from the storage chamber into the output conduit 65 while preventing the passage of ice particles.

The partially frozen solution containing the ice particles enters the storage chamber 56*a* through a return header 68*a* which is disposed in the lower end of thereof. The ice particles will float toward the surface 70*a* of the body of secondary refrigerant which is stored within the storage chamber 56*a* wherein they will accumulate to form a porous ice bed 74*a*. A portion of the liquid phase refrigerant which is withdrawn from the storage chamber 56*a* through conduit 64*a* may be circulated through the pump 80 (FIG. 1) of the heat source and through the heat exchanger 58 (FIG. 1).

The return header 76*a* is arranged to discharge the heated liquid phase refrigerant into contact with the ice bed such that the heated refrigerant must pass through at least a portion of the ice bed before it can be withdrawn from the storage chamber 56*a*, thus ensuring that it is cooled by contact with the ice bed.

In the embodiment illustrated in FIG. 1 the first compartment 60 may be completely filled with ice, in which case the ice bed will no longer float, however if the device 72 is a temperature sensine device it can be adjusted to be activated to interupt the supply of ice before an excessive amount of ice is generated.

Figure 5:
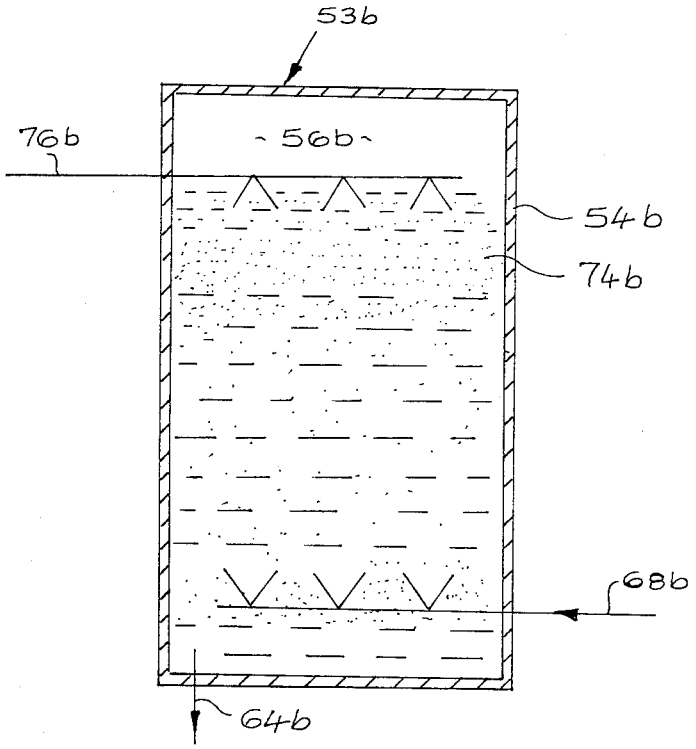
FIG. 5 is a diagram illustrating another construction of a thermal storage heat exchanger.

Yet another thermal storage heat exchanger 53*b* is illustrated in FIG. 5. The thermal storage heat exchanger 53*b* comprises a storage tank 54*b* within which a storage chamber 56*b* is formed. Again the barrier wall 58 (FIG. 1) is not required as the liguid phase refrigerant is seperated from the ice by reason of the shape of the storage chamber which is vertically elongated such that an ice bed 74*b* of substantial thickness may be formed while leaving a liguid bath of substantial depth below the ice bed from which the liquid phase refrigerant may be withdrawn without fear of clogging output conduit with ice. The natural buoyance of the ice which is admitted to the chamber causes the ice to rise to accumulate on the surface of the liquid where it forms the ice bed and this action is sufficient, in a storage chamber of sufficient height, to effect an adequate seperation of ice and liquid phase refrigerant without requiring a barrier wall.

The partially frozen solution containing the ice particles enters the storage chamber 56*b* through a return header 68*b* which is disposed in the lower end of thereof. The ice particles will float toward the surface 70*b* of the body of secondary refrigerant which is stored within the storage chamber 56*b* wherein they will accumulate to form a porous ice bed 74*b*. A portion of the liquid phase refrigerant which is withdrawn from the storage chamber 56*a* through conduit 64*b* may be circulated through the pump 80 (FIG. 1) of the heat source and through the heat exchanger 58 (FIG. 1).

The return header 76*b* is arranged to discharge the heated liquid phase refrigerant into contact with the ice bed such that the heated refrigerant must pass through at least a portion of the ice bed before it can be withdrawn from the storage chamber 56*b*, thus ensuring that it is cooled by contact with the ice bed. While a portion of the ice bed will melt when contacted by contact the heated refrigerant the displaced liquid will float the ice bed upwardly so that a portion of the ice bed will always be presented to the incoming heated refrigerant.

To ensure an excessive amount of ice is not accumulated in the storage chamber 56*b*, a temperature sensing device may be used in place of the liquid level sensing device previously discribed with reference to FIG. 4. A temperature sensing device is particularly suitable in instalations where the entire storage chamber may be filled with ice and little or no liquid is present in the chamber after charging of the chamber is complete. The temperature sensing device may communicate with the pump 14 to deactivate it when a temperature below a predetermined level is detected thereby to ensure that the supply of super cooled refrigerant is interupted when the storage chamber is full of ice.

I claim:

1. In a heat pump having a heat source, a heat sink and a thermal storage heat exchanger in which heat energy is cyclically accumulated and discharged by circulation of a secondary refrigerant therethrough, the improvement wherein:

(i) the secondary refrigerant is an aqueous soluation having a concentration which is below its eutetic concentration, (ii) the heat sink is adapted to cool or super-cool the aqueous solution to generate cooled secondary refrigerant, which, when cooled is a liquid and when super-cooled, is partially frozen and contains fine ice particles in suspension, (iii) the thermal storage heat exchanger has a storage chamber, (iv) a first input communicating between said storage chamber and the heat sink for admitting said cooled secondary refrigerant, such that when super-cooled secondary refrigerant is admitted the ice particles will separate from the liquid phase refrigerant to form a porous ice bed and a substantially ice free liquid bath, and when the cooled liquid is admitted it will be directed into intimate contact with the ice bed in a manner such that it may pass through the pores of the porous ice bed prior to its return to the bath, (v) a first output communicating with said storage chamber for discharging liquid phase refrigerant from said storage chamber for circulation to said heat sink and/or said heat source.

2. A heat pump as claimed in claim 1 wherein said heat source communicates with said storage chamber for admitting heated refrigerant from the heat source sink to said storage chamber such that it is discharged into said chamber such that it is placed in intimate contact with the ice bed in a manner such that it may pass through the pores of the porous ice bed prior to its return to the bath.

3. A heat pump as claimed in claim 1 further comprising a second input communicating between said storage chamber and the heat source for admitting heated refrigerant from the heat source sink to said storage chamber such that it is discharged into said chamber such that it is placed in intimate contact with the ice bed in a manner such that it may pass through the pores of the porous ice bed prior to its return to the bath.

4. A heat pump as claimed in claim 1 wherein an ice bed is formed in said storage chamber such that it floats on a bath of liquid phase refrigerant and wherein means is provided to prevent the removal of ice from the storage chamber through said first output whereby only liquid phase refrigerant is removed from said storage chamber for circulation to said heat sink and/or said heat source.

5. A heat pump as claimed in claim 1 wherein an ice bed is formed in said storage chamber such that it floats on a bath of liquid phase refrigerant and wherein said storage chamber is proportioned to ensure the formation of a substantial bath of liquid phase refrigerant below the ice bed thereby to prevent the removal of ice from the storage chamber through said first output whereby only liquid phase refrigerant is removed from said storage chamber for circulation to said heat sink and/or said heat source.

6. A heat pump as claimed in claim 1 wherein said first output conduit has a plurality of perforated feeder lines extending therefrom into the ice bed through which only liquid phase refrigerant may be removed from said storage chamber for circulation to said heat sink and/or said heat source.

7. A heat pump as claimed in claim 1 wherein said second input communicates with said storage chamber a substantial distance above the bath and wherein the first output communicates with said storage chamber at a level below the ice bed.

8. A heat pump as claimed in claim 1 wherein the second input communicates with said storage chamber at a level above the ice bed so as to discharge heated refrigerant from the heat source sink on to the ice bed.

9. A heat pump as claimed in claim 1 wherein an ice bed is formed in said storage chamber such that it floats on a bath of liquid phase refrigerant and wherein said first input communicates with said storage chamber at a level below the ice bed such that the partially frozen binary solution is admitted to the chamber below the ice bed and the ice particles which are discharged into the storage chamber float upwardly to regenerate the ice bed.

10. A heat pump as claimed in claim 9 further comprising a bath temperature sensing device for monitoring the temperature of the liquid bath in the chamber, said sensing device being operable to deactivate said heat sink when the temperature of the liquid phase refrigerant in the bath drops below a predetermined value.

11. A heat pump as claimed in claim 1 further comprising a bath level sensing device for monitoring the level of the bath in the chamber, said sensing device being operable to deactivate said heat sink when the level of liquid phase refrigerant in the bath drops below a predetermined level.

* * * * *